United States Patent [19]

Secrist et al.

[11] 4,029,504

[45] June 14, 1977

[54] PHOTOGRAPHIC IMAGE TRANSFER ELEMENTS CONTAINING NEUTRALIZING LAYERS COMPRISING PARTICULATE MATERIALS

[75] Inventors: George Richard Secrist, Webster; Richard Warren Berls; Brooke Pershing Schlegel, both of Rochester, all of N.Y.

[73] Assignee: Eastman Kodak Company, Rochester, N.Y.

[22] Filed: Apr. 14, 1976

[21] Appl. No.: 676,946

[52] U.S. Cl. ..... 96/29 D; 96/3; 96/73; 96/76 R; 96/77; 96/119 R; 428/451; 428/452; 428/454; 428/538

[51] Int. Cl.[2] ..... G03C 7/00; G03C 5/54; G03C 1/48; G03C 1/40

[58] Field of Search ..... 96/3, 29 D, 77, 76 R, 96/114.5, 73, 119 R; 428/451, 452, 454, 538

[56] References Cited

UNITED STATES PATENTS

| | | | |
|---|---|---|---|
| 2,616,807 | 11/1952 | Land | 96/76 R |
| 2,635,048 | 4/1953 | Land | 96/76 R |
| 3,920,456 | 11/1975 | Nittel et al. | 96/68 |

OTHER PUBLICATIONS

B 351,673, Jan. 1975, Fleckenstein et al., 96/3.

*Primary Examiner*—David Klein
*Assistant Examiner*—Richard L. Schilling
*Attorney, Agent, or Firm*—Arthur H. Rosenstein

[57] ABSTRACT

A neutralizing layer containing particulate diatomaceous earth, exploded volcanic rock or hydrous calcium silicate is described for use in color diffusion transfer film units, dye image-receiving elements and cover sheets.

22 Claims, No Drawings

PHOTOGRAPHIC IMAGE TRANSFER ELEMENTS CONTAINING NEUTRALIZING LAYERS COMPRISING PARTICULATE MATERIALS

This invention relates to photography and more particularly to color photography for color diffusion transfer units wherein a neutralizing layer is employed comprising particulate material.

In color diffusion transfer assemblages, a "shutdown" mechanism is needed to stop development after a predetermined time, such as 20–60 seconds in some formats or up to 3 minutes in others. Since development occurs at a high pH, it can be stopped by merely lowering the pH. The use of a neutralizing layer such as a polymeric acid can be employed for this purpose which will stabilize the element after the required diffusion of dyes has taken place. A timing layer is employed in conjunction with the neutralizing layer so that the pH is not prematurely lowered, which would stop development. The development time is thus established by the time it takes the alkaline composition to penetrate through the timing layer. As the system starts to become stabilized, alkali is depleted throughout the structure causing silver halide development to cease in response to this drop in pH. For each image-generating unit, this shutoff mechanism can establish the amount of silver halide development and the related amount of dye formed according to the respective exposure values.

Various formats for color diffusion transfer assemblages are described in the prior art, such as U.S. Pat. Nos. 3,415,644, 3,415,645, 3,415,646, 3,647,437, 3,636,707 and 3,756,815 and Canadian Pat. Nos. 928,559 and 674,082. In these formats, the image-receiving layer containing the photographic image for viewing can remain permanently attached and integral with the image-generating and auxiliary layers present in the structure when a transparent support is employed on the viewing side of the assemblage. The image is formed by dyes, produced in the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image-generating layers begin to diffuse throughout the structure. At least a portion of the imagewise distribution of diffusible dyes diffuses to the dye image-receiving layer to form an image of the original subject.

Other so-called "peel-apart" formats for color diffusion transfer assemblages are described, for example, in U.S. Pat. Nos. 2,983,606, 3,362,819 and 3,362,821. In those formats, the image-receiving element is separated from the photosensitive element after development and transfer of the dyes to the image-receiving layer.

This invention is particularly useful in a photographic silver halide color diffusion transfer system in a laminated integral-negative-receiver format and the improvement resulting from the prevention of spot defects caused by gas generated within the laminate.

A preferred format of the color transfer elements of this invention is depicted in Canadian Pat. No. 928,559 and British Pat. No. 1,405,662 which describe an integral color transfer format consisting of a laminated sandwich of an integral-negative-receiver element, a transparent processing cover sheet and, between them, an opaque viscous processing composition spread by rupturing a pod by drawing the transfer sandwich between a pair of juxtaposed rollers. On the transparent film support of the integral-negative-receiver are coated successively an image-receiving layer, a white reflective pigment layer, an opaque layer, three image-forming units and an overcoat layer. On the transparent film support of the cover sheet are coated successively a neutralizing layer and a timing layer. The unit is exposed through the cover sheet and processed by a viscous processing composition by breaking the pod. Viewing of the image is from the opposite side of the cover sheet.

Cover sheets useful for the above format, as well as for all other color transfer systems, are described in British Pat. Nos. 878,064 and 1,340,349 and U.S. Pat. No. 3,414,411. U.S. Pat. No. 2,616,807 describes a color transfer unit containing a processing composition comprising diatomaceous earth as a matting agent.

A particular problem with the above units, and specifically the unit described in Canadian Pat. 928,559, is that air from various parts of the system, including the processing composition, becomes trapped in the neutralizing layer which coalesces to form unsightly ripple defects and bubbles on the surface of the laminate closest to the neutralizing layer. Thus, in the unit described in Canadian Pat. No. 928,559, the defects are seen in the black back side of the laminate.

It has been discovered that the blemishes occurring on the surface of the laminate closest to the neutralizing layer can be substantially prevented by incorporating in the neutralizing layer particulate material selected from the group consisting of diatomaceous earth, exploded volcanic rock and hydrous calcium silicate.

Additionally, the addition of the particulate material as described above provides protection against the premature diffusion of light (light-piping) through the acid layer.

The neutralizing layer of the invention preferably contains at least one polycarboxylic acid such as dibasic acid half-ester derivatives of cellulose, which derivatives contain free carboxyl groups, e.g., cellulose acetate hydrogen phthalate, cellulose acetate hydrogen glutarate, cellulose acetate hydrogen succinate, ethyl cellulose hydrogen succinate, ethyl cellulose acetate hydrogen succinate, cellulose acetate hydrogen succinate hydrogen phthalate, ether and ester derivatives of cellulose modified with sulfoanhydrides, e.g., with ortho-sulfobenzoic anhydride, polystyrene sulfonic acid, carboxymethyl cellulose, polyvinyl hydrogen phthalate, polyvinyl acetate hydrogen phthalate, polyacrylic acid, polymethacrylic acid, acetals of polyvinyl alcohol with carboxy or sulfo-substituted aldehydes, e.g., o-, m- or p-benzaldehyde sulfonic acid or carboxylic acid, partial esters of ethylene/maleic anhydride copolymers, partial esters of methylvinyl ether/maleic anhydride copolymers, and the like such as described in U.S. Pat. No. 3,362,819. Copolymers of polycarboxylic acids are also quite useful such as poly(butyl acrylate-co-acrylic acid), poly(methyl vinyl ether-co-maleic anhydride), poly-(ethylene-co-maleic anhydride) and partial esters thereof and the like. Preferred neutralizing layers include poly-(butyl acrylate-co-acrylic acid) and polyacrylic acid, especially when hardened with hardeners such as bisepoxides.

The neutralizing layer contains particulate material selected from the group consisting of diatomaceous earth, exploded volcanic rock and hydrous calcium silicate. The material must be particulate and can generally be of any particle size. There is no practical limit as to how fine the particles may be, so that particle sizes of 1$\mu$ m or lower can be used. It is preferred to use particles having a particle size of 10 $\mu$m or less for ease of coating and to avoid lumps and to prevent the particles from protracting from the dried layer. Particularly preferred are particle sizes from 2–8 $\mu$m.

The acid or neutralizing layer should contain from about 50 to about 800 mg./m.$^2$ of the particulate material and preferably from about 75 to about 500 mg./m.$^2$ to achieve the most favorable results.

All grades of diatomaceous earth can be used to achieve beneficial results, such as the commercial grades of Celite, Dicalite and the like, as well as various grades of exploded volcanic rock (Perlite) and hydrous calcium silicate.

The preferred particulate material is diatomaceous earth.

The neutralizing layer containing polycarboxylic acid is preferably hardened or crosslinked to maintain the integrity of the layer and adhesion to adjacent layers during and after processing. If the acid layer is not properly hardened, fine bubbles move more freely throughout the neutralizing layer and may coalesce to form the objectionable larger bubbles. Although the use of the particulate material in the acid layer decreases the blemishes in cover sheets when the acid layer is hard or soft, when the acid layer is optimally hardened, less blemishes are likely to form. It is noted, however, that some acid copolymers such as the butyl acrylate/acrylic acid copolymer do not have to be hardened.

As the liquid from the contents of the pod diffuse throughout the film unit, the timing layer is penetrated and the polymeric acid layer is substantially neutralized. This layer containing mostly the alkali metal salt of the polymeric acid swells and becomes the softest layer in the unit. Bubbles of gas generally appear in this layer.

Although the present invention contemplates the use of the particulate material in a layer contiguous the neutralizing layer, the addition of the particulate material to other layers of color transfer film units such as in the processing composition or in the timing layer has not been as successful in avoiding blemishes in the cover sheet.

A photographic film unit according to this invention comprises:

a. a support having thereon at least one photosensitive siliver halide emulsion layer having associated therewith a dye image-providing material;
b. a dye image-receiving layer;
c. means for discharging an alkaline processing composition within the film unit;
d. a neutralizing layer for neutralizing said alkaline processing composition after a predetermined time; and
e. a timing layer which is permeable by said alkaline processing composition;

the film unit preferably containing a silver halide developing agent, and wherein the neutralizing layer contains particulate material selected from the group consisting of diatomaceous earth, exploded volcanic rock and hydrous calcium silicate.

One embodiment of an assemblage of an integral negative-receiver color diffusion transfer film unit in which the timing layer can be employed on a cover sheet is disclosed in Canadian Pat. No. 928,559 as described above. In this embodiment, the support for the photosensitive element is transparent and is coated with the image-receiving layer, a light-reflective layer, an opaque layer and photosensitive layers, having associated therewith dye image-providing material layers. A rupturable container containing an alkaline processing composition and an opacifier such as carbon black is positioned adjacent the top layer and a transparent cover sheet. The cover sheet comprises a transparent support which is coated with a neutralizing layer containing the particulate material and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage to protect it from exposure. The processing composition develops each silver halide layer and dye images are formed as a result of development which diffuse to the image-receiving layer to provide a right-reading image which is viewed through the transparent support on the opaque reflecting layer background. The neutralizing layer then neutralizes the alkaline processing composition after the timing layer breaks down, thus "shutting off" the system.

Another embodiment of an assemblage of an integral color diffusion transfer film unit in which this invention can be employed in a dye image-receiving element is described in U.S. Pat. No. 3,415,644 and 3,647,437. In this embodiment, the negative comprises an opaque support which is coated with photosensitive layers having associated therewith dye image-providing material layers. A rupturable container containing an alkaline processing composition, $TiO_2$ and an indicator dye (U.S. Pat. No. 3,647,437) is positioned adjacent the top layer and a transparent receiver. The receiver comprises a transparent support which is coated with a neutralizing layer containing the particulate material, a timing layer and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the assemblage to protect the element from exposure. The processing composition develops each silver halide layer and dye images formed in the unexposed areas diffuse to the image-receiving layer which is viewed through the transparent support on a white background - the indicator dye from the processing composition having "shifted" to a colorless form as the alkali is consumed by the neutralizing layer. As before, the neutralizing layer neutralizes the alkaline processing composition after the timing layer breaks down to "shut off" the system. For further details concerning the format of this particular assemblage, reference is made to the above-mentioned U.S. Pat. Nos. 3,415,644 and 3,647,437, which are incorporated herein by reference. Since the image in this embodiment is geometrically reversed, an image-reversing optical system such as a mirror in the camera is needed to reverse the image so that a right-reading image is viewable in the dye image-receiving layer.

Another embodiment of a film unit in which the layer of this invention can be employed with a dye image-receiving element is described in U.S. Pat. No. 3,362,819. The image-receiving element comprises a support, which is usually opaque, having thereon a neutralizing layer containing the particulate material, a timing layer and a dye image-receiving layer. For further details concerning the use of such an element in color transfer assemblages, reference is made to the above-mentioned U.S. Pat. No. 3,362,819, which is incorporated herein by reference.

Still other useful integral formats in which this invention can be employed are described in U.S. Pat. No. 3,362,821, 3,415,645, 3,415,646, 3,647,437 and 3,635,707 and British Pat. No. 1,330,524.

The photosensitive element useful in this invention can be treated with an alkaline processing composition to effect or initiate development in any manner. A preferred method for applying processing composition is by use of a rupturable container or pod which contains the composition. In general, the processing composition employed in this invention contains the developing agent for development, although the composition could also just be an alkaline solution where the developer is incorporated in the photosensitive element, in which case the alkaline solution serves to activate the incorporated developer.

The dye image-providing materials which may be employed in this invention generally may be characterized as either (1) initially soluble or diffusible in the processing composition but being selectively rendered nondiffusible in an imagewise pattern as a function of development, such as those disclosed, for example, in U.S. Pat. No. 2,647,049, 2,661,293, 2,698,244, 2,698,798, 2,802,735, 2,774,668 and 2,983,606, or (2) initially insoluble or nondiffusible in the processing composition but being selectively rendered diffusible in an imagewise pattern as a function of development, such as those disclosed, for example, in U.S. Pat. Nos. 3,227,550, 3,227,551, 3,227,552, 3,227,554, 3,243,294 and 3,445,228. These materials may be preformed dyes or dye precursors, e.g., color couplers, oxichromic compounds and the like.

In a preferred embodiment of this invention, the dye image-providing material is a nondiffusible redox dye releaser. Such compounds are, generally speaking, compounds which can be oxidized by oxidized developing agent, i.e., crossoxidized, to provide a species which will release a diffusible dye, such as by alkaline hydrolysis. Such redox dye releasers are described in U.S. Pat. Nos. 3,725,062 of Anderson and Lum issued Apr. 3, 1973, 3,698,897 of Gompf and Lum issued Oct. 17, 1972, 3,628,952 of Puschel et al. issued Dec. 21, 1971, 3,443,939 of Bloom et al issued May 13, 1969, and 3,443,940 of Bloom et al issued May 13, 1969, and the following copending applications: Serial Nos. 351,673 of Fleckenstein et al and 351,700 of Fleckenstein, both filed Apr. 16, 1973, 331,727 and 331,729 of Landholm et al, both filed Feb. 12, 1973, 331,728 of Haase et al filed Feb. 12, 1973, and 326,628 of Hinshaw et al filed Jan. 26, 1973, the disclosures of which are hereby incorporated by reference.

In an especially preferred embodiment of this invention, the redox dye releasers in the Fleckenstein et al application Ser. No. 351,673 referred to above are employed. Such compounds are nondiffusible sulfonamido compounds which are alkali-cleavable upon oxidation to release a diffusible dye from the benzene nucleus and have the formula:

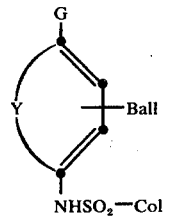

wherein:

1. Col is a dye or dye precursor moiety;
2. Ball is an organic ballasting radical of such molecular size and configuration (e.g., simple organic groups or polymeric groups) as to render the compound substantially nondiffusible in the photographic element during development in an alkaline processing composition;
3. Y comprises the atoms necessary to form a carrier such as phenyl, naphthyl or a heterocyclic moiety preferably containing from 5–7 carbon atoms; and
4. G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl phenethyl, etc., (when $R_1$ is an alkyl group of greater than 6 carbon atoms, it can serve as a partial or sole ballast group).

For further details concerning the above-described sulfonamido compounds and specific examples of same, reference is made to the above-mentioned Fleckenstein et al application Ser. No. 351,673 and Belgian Pat. No. 788,268 issued Feb. 28, 1972, the disclosures of which are hereby incorporated by reference.

In another preferred embodiment of this invention, initially diffusible dye image-providing materials are employed such as dye developers, including metal complexed dye developers such as those described in U.S. Pat. Nos. 3,453,107, 3,544,545, 3,551,406, 3,563,739, 3,597,200 and 3,705,184, and oxichromic developers as described and claimed in U.S. Pat. Ser. No. 308,869 by my coworkers Lestina and Bush filed Nov. 22, 1972, the disclosures of which are hereby incorporated by reference. When oxichromic developers are employed, the image is formed by the diffusion of the oxichromic developer to the dye image-receiving layer where it undergoes chromogenic oxidation to form an image dye.

The film unit of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive; i.e., the blue-sensitive silver halide emulsion layer will have a yellow dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentrations of the dye image-providing materials that are employed in the present invention may be varied over a wide range depending upon the particular compound employed and the results which are desired. For example, the dye image-providing compounds may be coated as dispersions in layers by using coating solutions containing a ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Any silver halide developing agent can be employed in this invention depending upon the particular chemistry system involved. The developer may be employed in the photosensitive element to be activated by the alkaline processing composition. Specific examples of developers which can be employed in this invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylenediamine
N,N,N′,N′-tetramethyl-p-phenylenediamine, etc.
4-hydroxymethyl-4-methyl-1-phenyl-3-pyrazolidinone, etc.

In using redox dye releaser compounds in this invention, the production of diffusible dye images is a function of development of the silver halide emulsions with a silver halide developing agent to form either negative or direct-positive silver images in the emulsion layers. If the silver halide emulsion employed forms a direct-positive silver image, such as a direct-positive internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then crossoxidizes the redox dye releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuses to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pat. No. 3,761,276 issued Sept. 25, 1973, 3,761,266 issued Sept. 25, 1973, and 3,761,267 issued Sept. 25, 1973. Internal-image silver halide emulsions can be defined in terms of the increased maximum density obtained when developed to a negative silver image with "internal-type" developers over that obtained when developed with developed with "surface-type" developers. Suitable internal-image emulsions are those which, when measured according to normal photograhic techniques by coating a test portion of the silver halide emulsion on a transparent support, exposing to a light-intensity scale having a fixed time between 0.01 and 1 sec., and developing for 3 min. at 20° C. in Developer A below ("internal-type" developer), have a maximum density at least 5 times the maximum density obtained when an equally exposed silver halide emulsion is developed for 4 min. at 20° C. in Developer B described below ("surface-type" developer). Preferably, the maximum density in Developer A is at least 0.5 density unit greater than the maximum density in developer B.

| Developer A | |
|---|---|
| hydroquinone | 15 g. |
| monomethyl-p-aminophenol sulfate | 15 g. |
| sodium sulfite (desiccated) | 50 g. |
| potassium bromide | 10 g. |
| sodium hydroxide | 25 g. |
| sodium thiosulfate | 20 g. |
| water to make 1 liter | |
| **Developer B** | |
| p-hydroxyphenylglycine | 10 g. |
| sodium carbonate | 100 g. |
| water to make 1 liter | |

The internal-image silver halide emulsions when processed in the presence of fogging of nucleating agents provide direct-positive silver images. Such emulsions are particularly useful in the above-described embodiment. Suitable fogging agents include the hydrazines disclosed by Ives, U.S. Pat. Nos. 2,588,982 issued Mar. 11, 1952, and 2,563,785 issued Aug. 7, 1951; the hydrazines and hydrazones disclosed by Whitmore, U.S. Pat. No. 3,227,552 issued Jan. 4, 1966; hydrazone quaternary salts described in British Pat. No. 1,283,835 and U.S. Pat. No. 3,615,615; hydrazone containing polymethine dyes described in U.S. Pat. No. 3,718,470; or mixtures thereof. The quantity of fogging agent employed can be widely varied depending upon the results desired. Generally, the concentration of fogging agent is from about 0.4 to about 8 g./mole of silver in the photosensitive layer in the photosensitive element or from about 0.1 to about 2 g./liter of developer if it is located in the developer. The fogging agents described in U.S. Pat. Nos. 3,615,615 and 3,718,470, however, are preferably used in concentrations of 25 to 500 mg./mole of silver in the photosensitive layer.

Typical useful direct-positive emulsions are disclosed in U.S. Pat. Nos. 3,227,552 by Whitmore issued Jan. 4, 1966, 3,761,276 by Evans issued Sept. 25, 1973, 3,761,267 by Gilman et al, 3,761,266 by Milton, 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pat. Nos. 3,367,778 by Berriman issued Feb. 6, 1968, and 3,501,305, 3,501,306 and 3,501,307 by Illingsworth, all issued Mar. 17, 1970.

In still other embodiments, the direct-positive emulsions can be of the type described by Mees and James, The Theory of the Photographic Process, published by MacMillan Co., New York, N.Y., 1966, pp. 149–167.

The various silver halide emulsion layers of a color assembly of the invention can be disposed in the usual order, i.e., the blue-sensitive silver halide emulsion layer first with respect to the exposure side, followed by the green-sensitive and red-sensitive halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,723,051, 3,056,492, 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color photographic assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 1 to 7 microns in thickness; and the alkaline solution-permeable polymeric interlayers, e.g., gelatin, are about 1 to 5 microns in thickness. Of course, these thicknesses are approximate only and can be modified according to the product desired.

The alkaline solution-permeable, light-reflective layer employed in certain embodiments of photographic assemblages of this invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes, may be added to it, or carbon black, nigrosine dyes, etc., may be coated in a separate layer adjacent the light-reflective layer. There could also be used a photographic diffusion reversal process wherein an image is made visible against a white pigment layer containing a white titanium dioxide pigment modified by precipitation thereon of hydrated aluminum oxide or of hydrated aluminum oxide together with hydrated silica dioxide as described in U.S. Pat. No. 3,928,037.

The neutralizing layer containing particulate material of this invention which becomes operative after permeation of the processing composition through the timing layer will effect a reduction in the pH of the image layers from about 13 or 14 to at least 11 and preferably 5–8 within a short time after imbibition. Such neutralizing or pH-lowering materials reduce the pH of the film unit after development to terminate development and substantially reduce further dye transfer and thus stabilize the dye image.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described by Minsk, U.S. Pat. No. 2,882,156 issued Apr. 14, 1959, and basic polymeric mordants such as described in U.S. Pat. Nos. 3,709,690 and 3,625,694 and copending U.S. Pat. Ser. Nos. 400,778 of Cohen et al filed Sept. 26, 1973, and 412,992 of Burness et al filed Nov. 5, 1973. Other mordants useful in this invention include poly-4-vinylpyridine, the 2-vinyl pyridine polymer metho-p-toluene sulfonate and similar compounds described by Sprague et al, U.S. Pat. No. 2,484,430 issued Oct. 11, 1949, and cetyl trimethylammonium bromide, etc. Effective mordanting compositions are also described in U.S. Pat. Nos. 3,271,148 by Whitmore and 3,271,147 by Bush, both issued Sept. 6, 1966, and in copending U.S. Pat. Ser. No. 525,248 by Campbell et al filed Nov. 19, 1974 now U.S. Pat. No. 3,958,995 issued May 25, 1976.

Other materials useful in the dye image-receiving layer include alkaline solution-permeable polymeric layers such as N-methoxymethyl polyhexylmethylene adipamide, partially hydrolyzed polyvinyl acetate, and other materials of a similar nature. Generally, good results are obtained when the image-receiving layer, preferably alkaline solution-permeable, is transparent and about 0.25 to about 0.40 mil in thickness. This thickness, of course, can be modified depending upon the result desired. The image-receiving layer can also contain ultraviolet-absorbing materials to protect the mordanted dye images from fading due to ultraviolet light, brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g., sodium hydroxide, sodium carbonate or an amine such as diethylamine, preferably possessing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of this invention, an opacifying agent, e.g., $TiO_2$, carbon black, indicator dyes, etc., may be added to the processing composition. In addition, ballasted indicator dyes and dye precursors may be present in the photographic assemblage as a separate layer on the exposure side of the photosensitive layers, the indicator dyes being preferably transparent during exposure and becoming colored or opaque after contact with alkali from the processing composition.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-$\alpha$-olefins such as polyethylene and polypropylene film, and related films or resinous materials. The support is usually about 2 to 9 mils in thickness. Ultraviolet-absorbing materials may also be included in the supports or as a separate layer on the supports, if desired.

The silver halide emulsions useful in this invention are well-known to those skilled in the art and are described in Product Licensing Index, Vol. 92, December, 1971, publication 9232, p. 107, paragraph I, "Emulsion types;" they may be chemically and spectrally sensitized as described on p. 107, paragraph III, "Chemical sensitization," and pp. 108–109, paragraph XV, "Spectral sensitization," of the above article; they can be protected against the production of fog and can be stabilized against loss of sensitivity during keeping by employing the materials described on p. 107, paragraph V, "Antifoggants and stabilizers," of the above article; they can contain development modifiers, hardeners, and coating aids as described on pp. 107–108, paragraph IV, "Development modifier;" paragraph VII, "Hardeners;" and paragraph XII, "Coating aids," of the above article; they and other layers in the photographic elements used in this invention can contain plasticizers, vehicles and filter dyes described on p. 108, paragraph XI, "Plasticizers and lubricants," and paragraph VIII, "Vehicles," and p. 109, paragraph VI, "Absorbing and filter dyes," of the above article; they and other layers in the photographic elements used in this invention may contain addenda which are incorporated by using the procedures described on p. 109, paragraph XVII, "Methods of addition," of the above article; and they can be coated by using the various techniques described on p. 109, paragraph XVIII, "Coating procedures," of the above article, the disclosures of which are hereby incorporated by reference.

The following examples further illustrate the invention.

EXAMPLE 1

Processing cover sheets were prepared by coating the following two layers on transparent poly(ethylene terephphthalate) film supports:

Control A

1. A layer of poly(acrylic acid) (16 g./m.$^2$) containing 0.8 g./m.$^2$ methoxymethyl melamine hardener
2. A timing layer of 95/5 mixture of cellulose acetate (40% acetyl) and poly(styrene-co-maleic anhydride) at 4.3 g./m.$^2$ Example 1 — The coating of Control A except that layer 1 additionally contained 160 mg./m.$^2$ of diatomaceous earth (Celite White Mist®diatomaceous earth from Johns Manville).

Each sample of the cover sheets was then used in processing a multicolor integral-negative-receiver element prepared by coating the following layers in the order recited on a transparent cellulose acetate film support:

1. image-receiving layer of poly[styrene-co-N-benzyl-N,N-dimethyl-N-vinylbenzylammonium chloride-co-divinylbenzene] latex (2.2 g./m.$^2$) and gelatin (2.2 g./m.$^2$);
2. reflecting layer of titanium dioxide (21.5 g./m.$^2$) and gelatin (3.2 g./m.$^2$);
3. opaque layer of carbon black (2.7 g./m.$^2$) and gelatin (1.7 g./m.$^2$);
4. Compound 1 (0.54 g./m.$^2$) (described hereinafter) and gelatin (1.1 g./m.$^2$);
5. red-sensitive, internal-image gelatin-silver bromide emulsion (1.1 g. gelatin/m.$^2$ and 1.2 g. silver/m.$^2$), 2,5-di-sec-dodecylhydroquinone (16 g./mole silver) and nucleating agent Compound 4 (300 mg./mole of silver);
6. interlayer of gelatin (1.1 g./m.$^2$) and 2,5-di-sec-dodecylhydroquinone (1.1 g./m.$^2$);
7. Compound 2 (0.54 g./m.$^2$) in diethyllamamide (0.27 g./m.$^2$) and gelatin (1.1 g./m.$^2$);
8. green-sensitive, internal-image gelatin-silver bromide emulsion (1.1 g./m.$^2$ and 1.35 g. silver/m.$^2$), 2,5-di-sec-dodecylhydroquinone (16 g./mole silver) an nucleating agent Compound 4 (400 mg./mole of silver);
9. interlayer of gelatin (1.2 g./m.$^2$) and 2,5-di-sec-dodecylhydroquinone (1.1 g./m.$^2$);
10. Compound 3 (0.86 g./m.$^2$) in diethyl lauramide (0.43 g./m.$^2$) and gelatin (1.1 g./m.$^2$);
11. blue-sensitive, internal-image gelatin-silver bromide emulsion (1.1 g. gelatin/m.$^2$ and 1.25 g. silver/m$^2$), 2,5-di-sec-dodecylhydroquinone (50 mg./ft.$^2$) and nucleating agent Compound 4 (500 mg./mole of silver); and
12. overcoat of gelatin (0.54 g./m.$^2$) and 2,5-di-sec-dodecylhydroquinone (0.11 g./m.$^2$).

The above silver halide emulsions are direct-positive emulsions having high sensitivity and low surface sensitivity of the type described in U.S. Patent 3,761,276. The photosensitive element was exposed to a tungsten light source through a graduated multicolor test object. The processing composition described below was employed in a pod and was spread between the photosensitive element and the transparent cover sheet described above at about 22° C. by passing the transfer sandwich between a pair of juxtaposed rollers so that the liquid layer was about 65 nm.

| Processing Composition | |
|---|---|
| potassium hydroxide (85%) | 56.0 g. |
| 4-hydroxymethyl-4-methyl-1-phenyl-3-pyrazolidinone | 8.0 g. |
| 5-methylbenzotriazole | 2.4 g. |
| t-butylhydroquinone | 0.2 g. |
| sodium sulfite (anhyd.) | 10.0 g. |
| carbon | 200.0 g. |
| dispersant | 2.5 g. |
| carboxymethyl cellulose | 66.0 g. |
| 1,4-cyclohexanedimethanol | 15.0 ml. |
| water | to 1000.0 ml. |

When viewed through the cover sheet, the integral unit prepared from Control Coating (A) without the particulate material showed an objectionable nonuniform pattern of large gas bubbles. The unit prepared from the coating of Example 1 with the diatomaceous earth showed a great reduction in ripples and large air bubbles in the cover sheet.

The above was repeated using various grades of diatomaceous earth including Celite White Mist® grades 305, 321A, 389 and 499 and Dicalite® grades L-10, 394 and 103. The results obtained were similar.

The following describe Compounds 1, 2, 3 and 4.

Compound 1

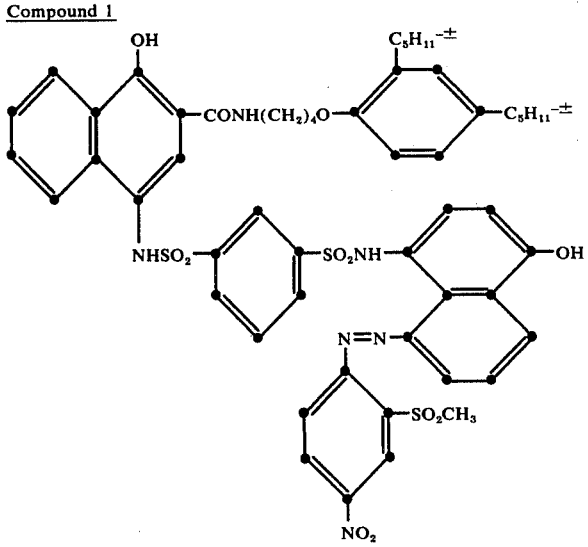

Compound 2

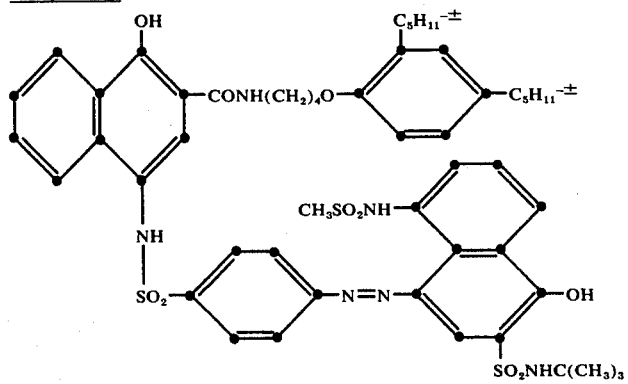

Compound 3

-continued

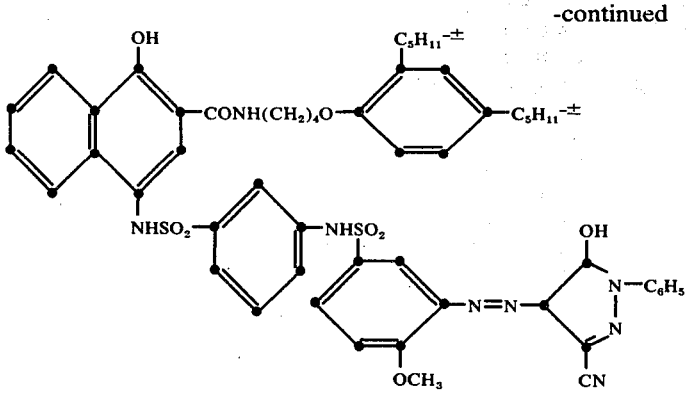

Compound 4 1-acetyl-2- 4-[5-amino-2-(2,4-di-tert-pentylphenoxy)benzamido]phenyl hydrazine

EXAMPLE 2

Processing cover sheets were prepared as in Example 1 except that, instead of diatomaceous earth, exploded volcanic rock (Bulk Aid®expanded perlites grades 2, 3 and 30) were added at 160 mg./m.$^2$ and the acid layer was hardened with 0.16 g./m.$^2$ of epoxy hardener (Araldite RD-2®hardener from Ciba Geigy) instead of methoxymethyl melamine. These sheets were processed as in Example 1 and the results showed only minute imperfections.

EXAMPLE 3

A processing cover sheet was prepared by coating the following layers on a transparent poly(ethylene terephthalate) film support:

1. an acid layer of a copolymer of butyl acrylate and acrylic acid (30/70 by weight, 16 g./m.$^2$); the layer contained 80 mg./m.$^2$ of diatomaceous earth (Dicalite 103®diatomaceous earth)
2. a timing layer as described in Example 1.

The integral unit was assembled and processed as in Example 2 and the back side of the picture unit was observed. The unit was free from ripples and the haze due to minute air bubbles was almost indistinguishable.

Examples 1 and 2 were repeated using cover sheets containing neutralizing layers containing hydrous calcium silicate (Micro Cel T-38® particles from John Manville) and expanded Perlite (exploded volcanic rock), and the results were almost as advantageous as those obtained using diatomaceous earth.

As a comparison, the above examples were also repeated using cover sheets containing neutralizing layers containing titanium dioxide particles, barium sulfate particles, crystalline quartz, precipitated silica, submicron silica, molecular sieves, attapulgite clay, carbon black and talc. When these cover sheets were processed as in Example 1, however, they were severely blemished.

EXAMPLE 4

This is a comparative example.

Processing cover sheets were prepared as in Control Coating A in Example 1 except that the neutralizing layer was hardened with 32 g./m.of epoxy hardener (Araldite RD-2®hardener from Ciba-Geigy) instead of methoxymethylmelamine. These sheets were processes as in Example 1 using a series of processing compositions containing varying amounts of diatomaceous earth instead of the composition described in Example 1. The compositions having the following common ingredients:

| | | |
|---|---|---|
| sodium hydroxide | 56 | g. |
| 4-hydroxymethyl-4-methyl-1-phenyl-3-pyrazolidinone | 8 | g. |
| 5-methylbenzotriazole | 2.4 | g. |
| t-butylhydroquinone | 0.2 | g. |
| sodium sulfite | 2 | g. |
| carboxymethylcellulose | 25 | g. |
| Celite White Mist | variable | |
| water | 1000 | ml. |

contained diatomaceous earth as the only particulate matter, carbon being omitted. Five compositions contained 0, 4.0, 10.0, 20.0 and 100.0 g./l. of Celite White Mist. The cover sheets all showed like amounts of objectionable deformities due to the large gas bubbles. The effects seen in Examples 1 and 2 are not observed when the diatomaceous earth is located in the liquid processing layer.

The invention has been described with particular reference to certain preferred embodiments thereof, but it will be understood that variations and modifications can be effected within the spirit and scope of the invention.

We claim:

1. In a photographic film unit comprising:

a. a photosensitive element comprising a support having thereon at least one photosensitive silver halide emulsion layer having associated therewith a dye image-providing material;

b. a dye image-receiving layer;

c. means for discharging an alkaline processing composition within said film unit;

d. a neutralizing layer for neutralizing said alkaline processing composition after a predetermined time; and e. a timing layer which is permeable by said alkaline processing composition; the improvement wherein said neutralizing layer contains particulate material selected from the group consisting of diatomaceous earth, exploded volcanic rock and hydrous calcium silicate.

2. The film unit of claim 1 wherein:

a. said dye image-receiving layer is located between said support and said silver halide emulsion layer; and b. said film unit also includes a transparent cover sheet over the layer outermost from said support.

3. The film unit of claim 2 wherein said transparent cover sheet is coated with said neutralizing layer and said timing layer respectively.

4. The film unit of claim 2 wherein said discharging means is a rupturable container containing said alkaline processing composition and an opacifying agent, said container being so positioned during processing of said film unit that a compressive force applied to said container will affect a discharge of the container's contents between said transparent sheet and the outermost layer of said photosensitive element.

5. The film unit of claim 1 wherein said neutralizing layer comprises at least one polycarboxylic acid.

6. The film unit of claim 5 wherein said neutralizing layer comprises a copolymer of butyl acrylate and acrylic acid.

7. The film unit of claim 1 wherein the neutralizing layer contains from about 50 to about 800 mg. per square meter of the particulate material.

8. The film unit of claim 7 wherein the particulate material has an average particle size of up to about 10 microns.

9. The film unit of claim 1 comprising:

a. the photosensitive element of claim 1 wherein said element also comprises the dye image-receiving layer of claim 1, said element comprising a transparent support having thereon the following layers in sequence: an image-receiving layer, an alkaline solution-permeable, light-reflective layer, an alkaline solution-permeable, opaque layer, a red-sensitive silver halide emulsion layer having a nondiffusible redox cyan dye releaser associated therewith, a green-sensitive silver halide emulsion layer having a nondiffusible redox magenta dye releaser associated therewith, and a blue-sensitive silver halide emulsion layer having a nondiffusible redox yellow dye releaser associated therewith;

b. a transparent sheet superposed over said blue-sensitive silver halide emulsion layer and comprising a transparent support coated with said neutralizing layer and said timing layer; and c. said means for discharging an alkaline processing composition within said film unit which comprises a rupturable container containing said alkaline processing composition and an opacifying agent, said container being so positioned during processing of said film unit that a compressive force applied to said container will effect a discharge of the container's contents between said transparent sheet and said blue-sensitive silver halide emulsion layer.

10. The film unit of claim 9 wherein each said redox dye releaser is a nondiffusible sulfonamido compound which is alkali-cleavable upon oxidation to release a diffusible color-providing moiety from the benzene nucleus, said compound having the formula:

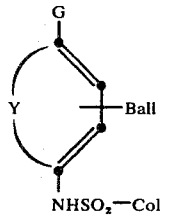

wherein:

a. Col is a dye or dye precursor moiety;

b. Ball is an organic ballasting radical of such molecular size and configuration as to render said compound nondiffusible in said photographic element during development in an alkaline processing composition;

c. Y represents the atoms necessary to complete a phenyl, naphthyl or a heterocyclic moiety containing from 5 to 7 carbon atoms; and d. G is OR or $NHR_1$ wherein R is hydrogen or a hydrolyzable moiety and $R_1$ is hydrogen or an alkyl group of 1 to 22 carbon atoms.

11. The film unit of claim 10 wherein each said silver halide emulsion is a direct-positive silver halide emulsion.

12. The film unit of claim 1 wherein sid dye image-receiving layer is located on a separate transparent support superposed over the layer outermost from an opaque support having thereon said photosensitive silver halide emulsion layer.

13. The film unit of claim 12 wherein said separate transparent support contains thereon said neutralizing layer and said timing layer.

14. The film unit of claim 1 wherein said support is transparent.

15. In a photographic film unit comprising:

a. a support having thereon at least one photosensitive silver halide emulsion layer having associated therewith a dye image-providing material;

b. a dye image-image receiving layer;

c. means for discharging an alkaline processing composition within said film unit;

d. a neutralizing layer for neutralizing said alkaline processing composition after a predetermined time; and e. a timing layer which is permeable by said alkaline processing composition;

the improvement wherein said neutralizing layer contains particulate diatomaceous earth.

16. In a process of producing a photographic transfer image in color from an imagewise-exposed photographic element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layers;

a. an imagewise distribution of dye image-providing material being formed as a function of development;

b. at least a portion of said imagewise distribution of dye image-providing material diffusing to a dye image-receiving layer;

c. a timing layer associated with a neutralizing layer being permeable by said alkaline processing composition after a predetermined time and wherein said layers are present in an image-receiving element or a cover sheet; and d. said alkaline processing composition being neutralized by means of said neutralizing layer associated with said photographic element after said predetermined time;

the improvement comprising incorporating in said neutralizing layer a particulate material selected from the group consisting of diatomaceous earth, exploded volcanic rock and hydrous calcium silicate.

17. The process of claim 16 wherein said neutralizing layer comprises at least one polycarboxylic acid.

18. The process of claim 17 wherein said neutralizing layer comprises a copolymer of butyl acrylate and acrylic acid.

19. The process of claim 16 wherein the neutralizing layer contains from about 50 to about 800 mg./meter$^2$ of the particulate material.

20. The process of claim 19 wherein the particulate material has an average particle size up to about 10 microns.

21. In a dye image-receiving element comprising a support having thereon, in order, a neutralizing layer, a timing layer and a dye image-receiving layer, the improvement comprising employing in said neutralizing layer particulate matter selected from the group consisting of diatomaceous earth, exploded volcanic rock and hydrous calcium silicate.

22. A cover sheet for use with a color diffusion transfer film unit comprising a transparent support having thereon, in order:

a. a neutralizing layer consisting essentially of acidic material for neutralizing an alkaline processing composition and particulate matter selected from the group consisting of diatomaceous earth, exploded volcanic rock and hydrous calcium silicate; and b. a timing layer.

* * * * *